US006104016A

United States Patent [19]

Lee

[11] Patent Number: 6,104,016

[45] Date of Patent: Aug. 15, 2000

[54] WALL-MOUNTED MICROWAVE OVEN AND METHOD FOR CONTROLLING HOOD MOTOR THEREFOR

[75] Inventor: Sung Ho Lee, Suwon, Rep. of Korea

[73] Assignee: SamSung Electronics Co., Ltd., Suwon, Rep. of Korea

[21] Appl. No.: 09/371,608

[22] Filed: Aug. 10, 1999

[30] Foreign Application Priority Data

Mar. 9, 1999 [KR] Rep. of Korea ..... 99-7719

[51] Int. Cl.[7] ..... H05B 6/68

[52] U.S. Cl. ..... 219/702; 219/716; 219/757; 126/299 R

[58] Field of Search ..... 219/702, 716, 219/718, 715, 757; 126/21 A, 273 A, 299 R, 299 D; 361/694, 695

[56] References Cited

U.S. PATENT DOCUMENTS 4,724,291 2/1988 Inumada ..... 219/718

5,268,547 12/1993 Bessyo et al. ..... 219/716

5,986,245 11/1999 Kang ..... 219/757

*Primary Examiner*—Philip H. Leung

*Attorney, Agent, or Firm*—Robert E. Bushnell, Esq.

[57] ABSTRACT

A wall-mounted microwave oven and a control method for controlling a hood motor are provided. Here, the wall-mounted microwave oven having a main body forming a cavity for accommodating foods to cook, a casing enclosing the main body and forming a hood duct having an inlet located on a bottom area and an outlet located on an upper area, a hood fan installed in the hood duct, and a hood motor driving the hood fan, includes an inverter part for controlling the frequency of a supply current supplied from an external electrical power source to the hood motor, and a microcomputer for controlling the speed of the hood motor by transmitting a control signal to the inverter part, based on an external control signal. Thus, the size of the hood motor can be reduced, thus reducing a cost. Also, since the speed of the hood fan can be varied, ventilation and exhaust are performed within an optimal time to thereby seek conveniences of users.

22 Claims, 5 Drawing Sheets

WALL-MOUNTED MICROWAVE OVEN AND METHOD FOR CONTROLLING HOOD MOTOR THEREFOR

CLAIM OF PRIORITY

This application makes reference to, incorporates the same herein, and claims all benefits for Controlling Hood Motor Therefor earlier filed in the Korean Industrial Property Office on Mar. 9, 1999 and there duly assigned Ser. No. 99-7719.

BACKGROUND OF THE INVENTION

1. Field of the Invention

The present invention relates to a wall-mounted microwave oven and a method for controlling a hood motor, and more particularly, to a wall-mounted microwave oven and a method for controlling a hood motor to vary the speed of the hood motor.

2. Description of the Related Art

A wall-mounted microwave oven is installed on the upper wall over a gas range, and functions as a hood for inhaling vapor and fumes generated during cooking foods and discharging the inhaled vapor and fumes to the outside.

As shown in FIGS. 1 and 2, the wall-mounted microwave oven includes a main body 53 and a casing 56 enclosing the main body 53. Between the casing 56 and the main body 53 is formed a hood duct 65 as a path for discharging vapor and fumes. On the lower surface of the casing 56 is formed an inlet for inhaling vapor and fumes into the hood duct 65. On the upper surface of the casing 56 is formed an outlet 59 to which a discharging tube 61 is connected. The discharging tube 61 is connected to a discharging path 67 which penetrates through the wall and communicates with the outside. Also, on the upper portion of the main body 53 adjacent to the outlet 59 is formed a hood fan 63 for discharging the vapor and fumes inhaled into the hood duct 65 via the inlet 58 to the outside via the outlet 59.

The hood fan 63 operates by a user's selection through a selection button provided in a control panel 35. As it being the case, a hood sensor 57 (FIG. 5) which turns on or off the hood fan 63 according to air temperature or smoke detection is provided to the inlet 58 of the hood duct 65 or the inside thereof, thereby controlling operation of the hood fan 63. Here, the hood sensor 57 is generally made of a bimetal.

FIG. 5 is a circuit diagram of a hood driver of a conventional wall-mounted microwave oven. The hood motor 95 is installed on an electric power line which connects first and second commercial alternating voltage (AC) electric power lines 51 and 52 in series which are extended from an external power source 55. On the electric power line where the hood motor 95 is installed, a hood fan switch 72 which turns on or off the hood motor 95 and a speed selection switch 73 for selecting a driving speed of the hood motor 95 at low or high speed are installed. Here, the speed selection switch 73 has a high speed contact 73*a* and a low speed contact 73*b* for turning on the hood motor 95, with a result that the hood motor 95 operates at high speed or at low speed. The speed selection switch 73 is normally connected to the low speed contact 73*b*.

Meanwhile, the hood sensor 57 is connected in parallel with the hood fan switch 72. As described above, the hood sensor 57 detects heat or gases transferred from a gas range 100 and is turned on when heat or gases are detected.

By this configuration, a selection button for driving the hood fan can be selected to discharge heat and fumes emitted from foods during cooking. Here, if a user presses the selection button once, a microcomputer 60 turns on the hood fan switch 72, in which case the speed selection switch ordinarily in contact with the low speed contact 73*b* drives the hood motor 95 at low speed. If the selection button is pressed twice, the microcomputer 60 directs the speed selection switch 73 to contact the high speed contact 73*a* to drive the hood motor 95 at high speed. If the selection button is pressed once again, the microcomputer 60 turns off the hood fan switch 72 to stop the hood motor 95.

Although the user does not manipulate the selection button, the hood sensor 57 is turned on to drive the hood motor 95 at low speed If it detects heat or fumes during cooking.

However, the conventional hood motor 95 can be controlled only at two levels, that is, at low speed and at high speed. Thus, if a user wishes the hood motor 95 to be driven faster than at high speed, or wishes the hood motor 95 to be driven at intermediate speed, such user's needs cannot be met. That is, the driving speed of the hood motor 95 cannot be adaptively controlled according to the degree of heat or fumes emitted.

To solve these problems, the winding number of coils is increased to enlarge the capacity of the hood motor 95, thereby controlling the rotational speed of the hood motor 95 in multiple steps. In the case that the winding number of coils is increased, the volume of the hood motor 95 also increases. In addition, as the number of steps are increased, the number of contacts in the speed selection switch 73 should be increased. As a result, cost of production increases and an assembling work is complicated.

SUMMARY OF THE INVENTION

To solve the above problems, it is an object of the present invention to provide a wall-mounted microwave oven in which the speed of the hood motor is adaptively controlled according to a cooking condition whose the speed of a hood motor is diversified.

It is another object of the present invention to provide a hood motor speed controlling method in a wall-mounted microwave oven which is adaptively controlled according to a cooking condition in which the speed of a hood motor is diversified.

To accomplish the above object of the present invention, there is provided a wall-mounted microwave oven having a main body forming a cavity for accommodating foods to cook, a casing enclosing the main body and forming a hood duct having an inlet located on a bottom area and an outlet located on an upper area, a hood fan installed in the hood duct, and a hood motor for driving the hood fan, the wall-mounted microwave oven comprising: an inverter part for controlling the frequency of a supply current supplied to the hood motor; and a microcomputer for controlling the speed of the hood motor by transmitting a control signal to the inverter part, based on an external control signal.

Preferably, the inverter part comprises first and second transistors which are alternately turned on and a driver for controlling the cycle of a driving signal according to the control signal supplied from the microcomputer and transmitting the controlled cycle to the first and second transistors.

The wall-mounted microwave oven further comprises a first switching unit provided on an electric power line connected to the inverter part, for turning on and off the power supply to the inverter part, and a hood sensor connected in parallel with the first switching unit, for detecting whether or not the operation of the hood fan is needed. Also, the wall-mounted microwave oven further comprises a speed control button for controlling the speed of the hood motor externally, in order to facilitate control of the speed of the hood motor.

Meanwhile, it is preferable that the microcomputer controls the cycle of the driving signal applied to the first and second transistors to be shortened in the case that the speed of the hood motor is increased, to thereby increasing the frequency of the supply current.

In addition, the microcomputer can turn on the first switching unit if the speed control button is selected while the hood motor is driven by means of the hood sensor.

According to another aspect of the present invention, there is also provided a hood motor speed controlling method in a wall-mounted microwave oven having a main body forming a cavity for accommodating foods to cook, a casing enclosing the main body and forming a hood duct having an inlet located on a bottom area and an outlet located on an upper area, a hood fan installed in the hood duct, and a hood motor for driving the hood fan, the hood motor speed controlling method comprising the steps of: generating driving signal to be supplied to the hood motor based on an external control signal; and altering the frequency of a current supplied from an external power source based on the driving signal, to then supply it into the hood motor.

Here, in the frequency altering step, the commercial frequency of 50 Hz or 60 Hz is increased up to 100 Hz to 1000 Hz.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Preferred embodiments of the present invention will be described in detail with reference to the accompanying drawings.

Figure 1:
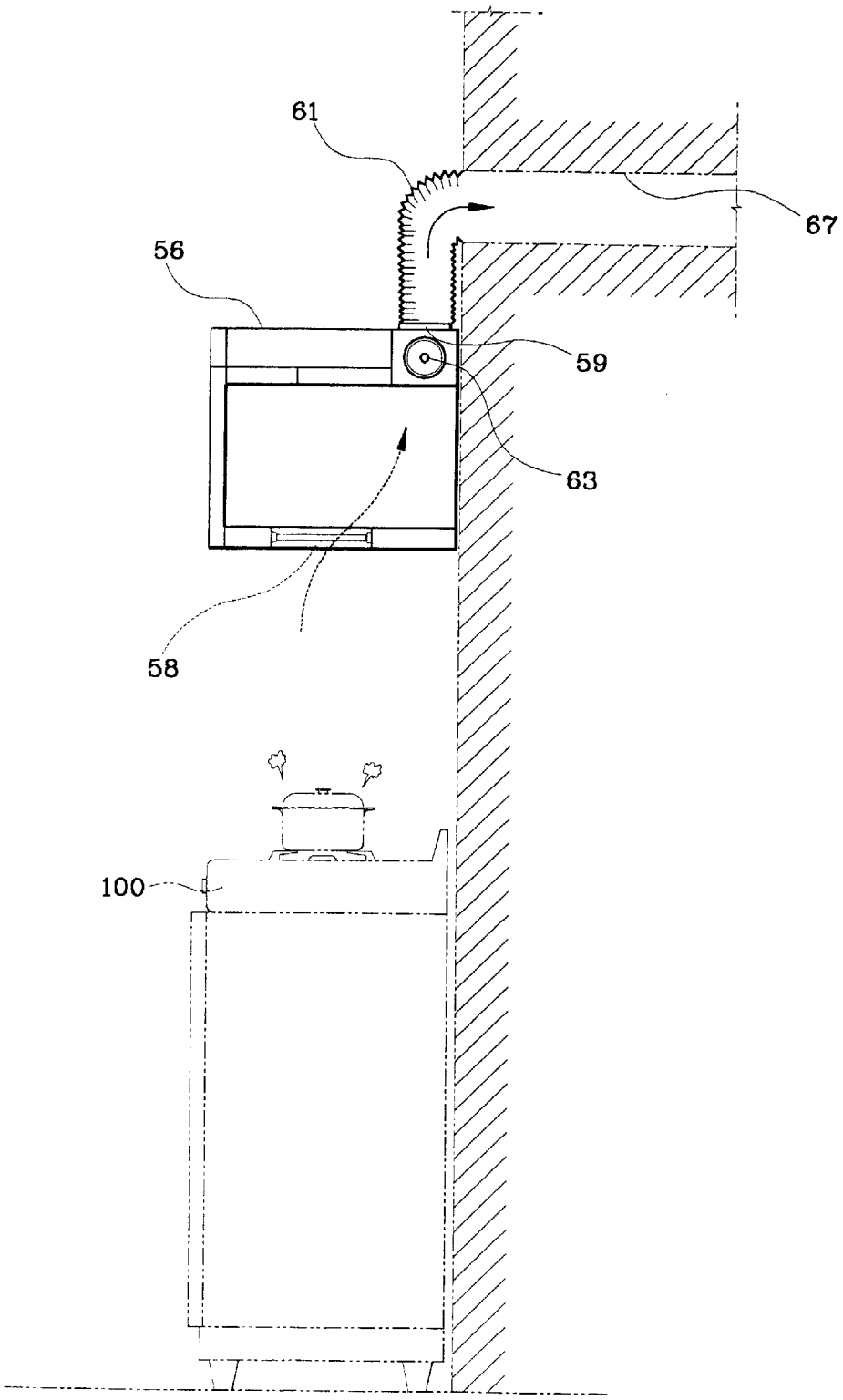
FIG. 1 is a schematic view of a wall-mounted microwave oven installed above a gas range.
Figure 2:
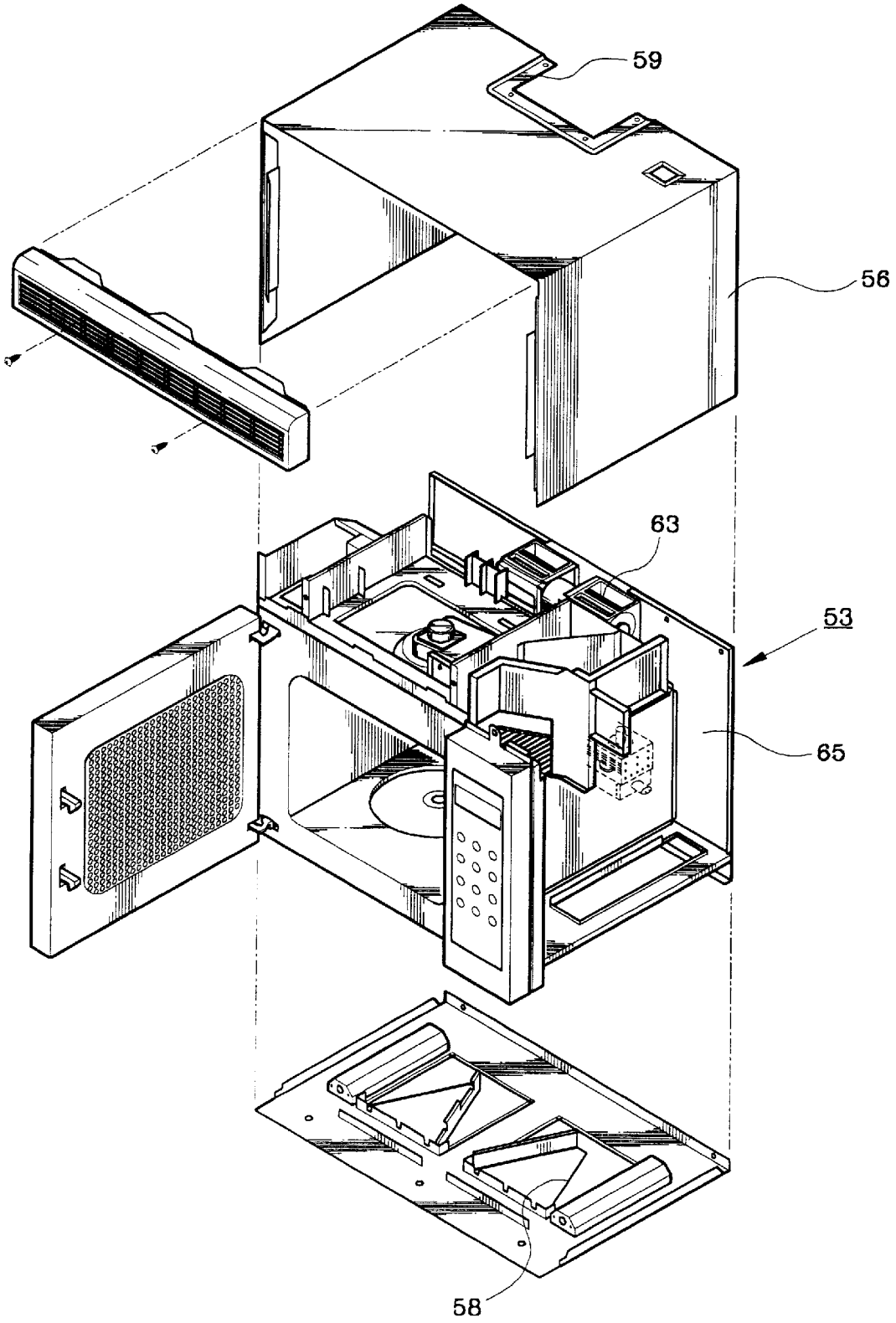
FIG. 2 is a partially exploded perspective view of a wall-mounted microwave oven.

The wall-mounted microwave oven according to the present invention has the same configuration as those of FIGS. 1 and 2 in external appearance. Thus, the detailed description thereof will be omitted.

Figure 3:
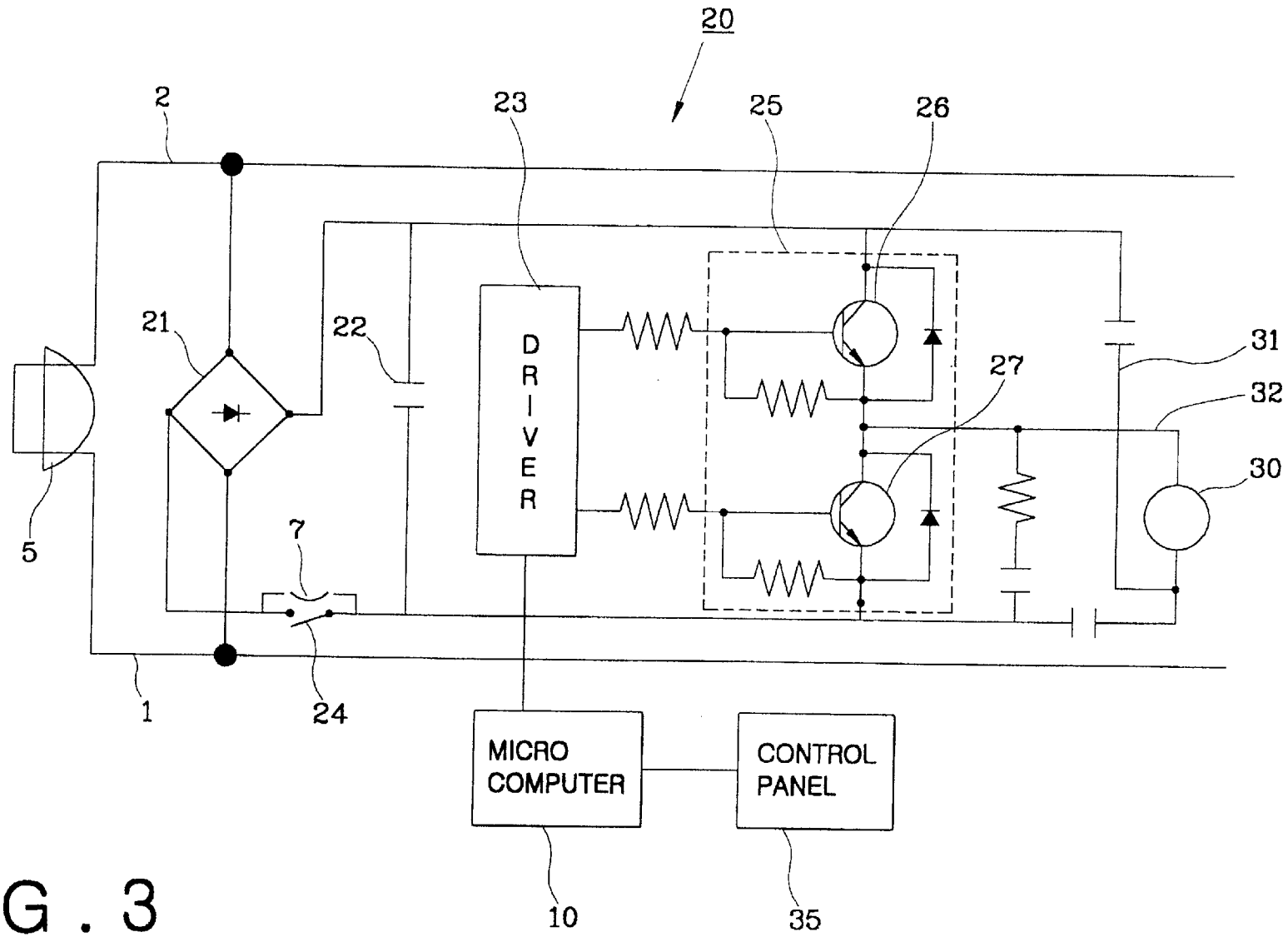
FIG. 3 is a circuit diagram of a hood driver in a wall-mounted microwave oven according to the present invention.

FIG. 3 is a circuit diagram of a hood driver 20 in a wall-mounted microwave oven according to the present invention. The hood driver 20 includes a hood motor 30 formed of an AC motor, and an inverter part 25 for adjusting the frequency of a current to be supplied to the hood motor 30. The inverter part 25 adjusts the frequency of the current to be supplied to the hood motor 30 according to a control signal supplied from a microcomputer 10.

The hood driver 20 includes a rectifier 21 disposed on an electric power line between a first commercial power line I and a second commercial power line 2, for rectifying an input AC current, and a smoothing unit 22 connected in parallel with the rectifier 21, for smoothing the rectified current, and supplies the rectified and smoothed current to the hood motor 30. Here, between the rectifier 21 and the smoothing unit 22 are connected a first switching unit 24 for cutting in and out the power supply to the inverter part 25, and a hood sensor 7 connected in parallel with the first switching unit 24, for detecting heat and/or fumes within a hood duct. Meanwhile, the inverter part 25 includes first and second transistors 26 and 27 connected in series on an electric power line connected in parallel with the smoothing unit 22, and a driver 23 applying a driving signal to each transistor 26 or 27 according to a control signal supplied from the microcomputer 10. Here, both the first and second transistors 26 and 27 are npn type transistors having dynamic characteristics and turned on and off alternately according to the driving signal supplied from the driver 23. The input end of the first transistor 26 and the output end of the hood motor 30 are mutually connected by means of a bypass electric power line 31. An electric power line between the first transistor 26 and the second transistor 27 and the input end of the hood motor 30 are connected by means of an electric power supply line 32.

As a result, if a high-level signal is input to the first transistor 26 from the driver 23 and thus the first transistor 26 is turned on, the second transistor 27 is turned off, in which case the current output from the smoothing unit 22 passes through the first transistor 26 and input to the hood motor 30 via the electric power supply line 32. Also, if a high-level signal is input to the second transistor 27 and thus the second transistor 27 is turned on, the first transistor 26 is turned off, in which case the current output from the smoothing unit 22 flows along the bypass electric power line 31 and is supplied to the output end of the hood motor 30. In this case, an electric power is not supplied into the hood motor 30. In this manner, if the on-and-off time of the first and second transistors 26 and 27 is controlled, the frequency of the supplied current can be varied. For example, a current which is supplied with the frequency of 50 Hz or 60 Hz in the prior art can be altered into the current with the frequency in the range of 100 Hz to 1000 Hz, preferably the frequency of 300 Hz. Thus, the frequency in the current can be altered within the above frequency range.

Meanwhile, as expressed in the following equation (1), the rotational speed of the hood motor 30 is proportional to the frequency of the current or voltage supplied. If the frequency is varied, the rotational speed of the hood motor 30 is also varied. Thus, if the frequency is increased up to 1000 Hz, the rotational speed of the hood motor 30 can be increased at ultra-high speed.

$$RPM = \frac{120 \times f}{THENUMBEROFPOLESINMOTOR} \tag{1}$$

Here, RPM is the number of rotations in the motor and f denotes the frequency. Meanwhile, a magnetic flux density of the motor is expressed as the following equation (2).

$$B = \frac{E}{4 \times F \times A_C \times N} \quad (2)$$

Here, B denotes a magnetic flux density, E an input voltage, F a frequency, and Ac a cross-sectional area, and N the number of coils.

According to the equation (2), if a frequency is increased as in the present invention when the magnetic flux density and the input voltage are constant, the cross-sectional area and the number of coils can be reduced.

Figure 4:
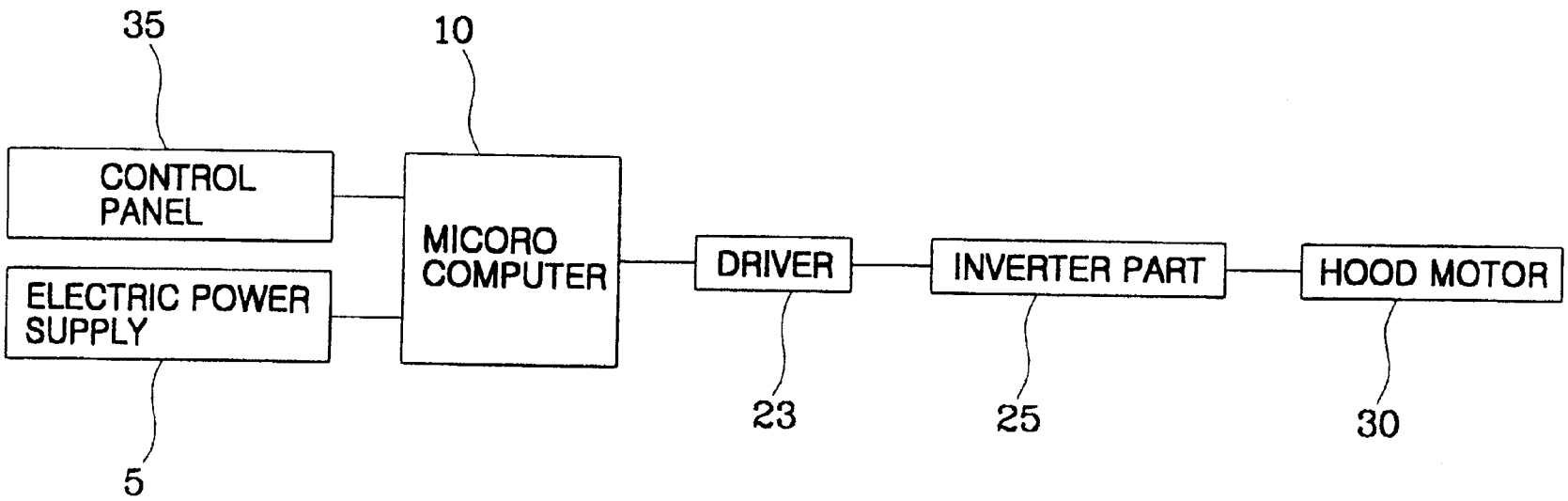
FIG. 4 is a control block diagram of the wall-mounted microwave oven of FIG. 3.
Figure 5:
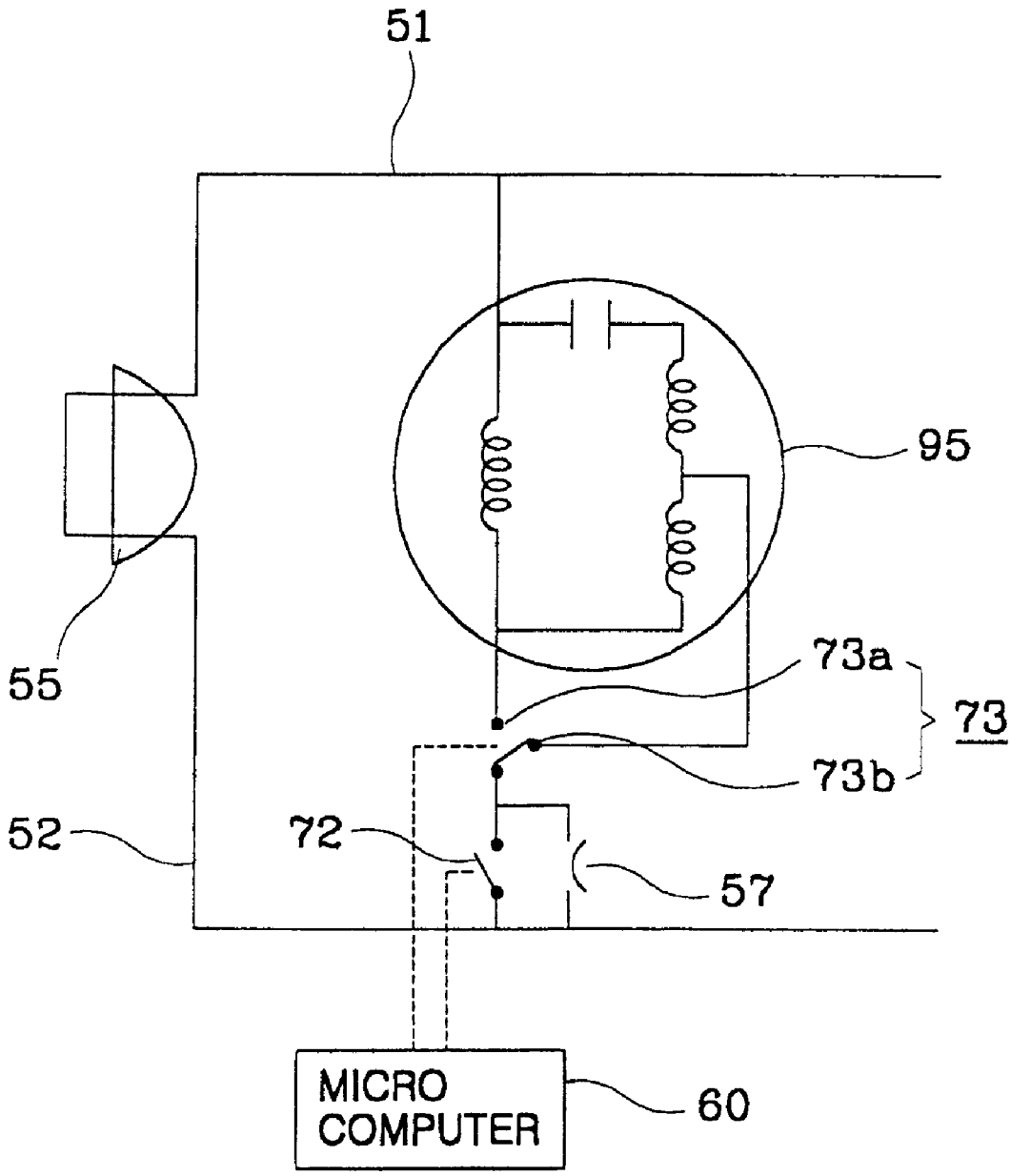
FIG . 5 (PRIOR ART)
FIG. 5 is a circuit diagram of a hood driver of a conventional wall-mounted microwave oven.

Meanwhile, the microcomputer 10 which adjusts the frequency of the current to be supplied to the hood motor 30 controls a generation cycle of the driving signal generated in the driver 23 according to the control signal supplied from an external control panel 35. Accordingly, the frequency of the current can be varied. Meanwhile, the control panel 35 is provided with a speed control button so that a user can control the speed of the hood motor 30. As shown in FIG. 4, the microcomputer 10 controlling the driving of the microwave oven receives the signal from the control panel 35 at the time when an electric power is applied from the electric power supply 5, and supplies the control signal to the driver 23. Accordingly, the driver 23 outputs the driving signal to the inverter part 25 to control the driving of the hood motor 30.

By the above configuration, if a user selects the speed control button and 23*b*) in order to discharge heat or fumes during using of a gas range, the microcomputer 10 turns on the first switching unit 24 and sends the control signal to the driver 23 according to the adjustment of the speed control button. Then, the driver 23 adjusts the supplying cycle of the driving signal and transmits the driving signal to the first and second transistors 26 and 27. Thus, when the user selects the speed control button at high speed, the supplying cycle of the driving signal supplied to the first and second transistors 26 and 27 from the driver 23 is shortened, while when the user selects the speed control button at low speed, the supplying cycle thereof is lengthened. Thus, the speed of the hood motor 30 is linearly increased or decreased within a speed interval from an ultra-high speed to a low speed, according to control of the speed control button. Meanwhile, although a user does not select the speed control button, if the hood sensor 7 detects heat or fumes, the hood sensor 7 is turned on. Accordingly, the current is supplied to the hood motor 30. Thus, the hood motor 30 is driven. Here, the hood motor 30 is driven at an appropriate speed which is preset in the microcomputer 10. Even though the hood motor 30 is driven by the hood sensor 7, if the user selects the speed control button, the microcomputer 10 supplies the driving signal applied from the driver 23 to the first and second transistors 26 and 27 to thus control the speed of the hood motor 30. As described above, in the present invention, the hood motor 30 is formed of an AC motor, and the frequency of the current supplied to the hood motor 30 is adjusted through the inverter part 25. Accordingly, the speed of the hood motor 30 can be varied linearly. The hood motor 30 can driven at ultra-high speed as well. Thus, since ventilation and exhaust can be controlled so as to be accomplished within an optimal time, conveniences are given to users.

Also, in the present invention, although a relatively low-capacity hood motor 30 is used in which the cross-sectional area and the number of coils in the hood motor 30 are reduced, the driving speed of the hood motor 30 can be enhanced. Thus, in the case that the same driving speed as the conventional art is desired, the cross-sectional area and the number of coils can be reduced, in which case a production cost is decreased and the volume of the hood motor 30 is reduced, to resultantly reduce the volume of the microwave oven. As described above, since the size of the hood motor can be reduced in the present invention, a production cost is reduced. Also, since the speed of the hood fan can be varied, ventilation and exhaust can be controlled so as to be accomplished within an optimal time, to thereby convenience users.

Although the present invention has been described in connection with preferred embodiment thereof, it will be appreciated by those skilled in the art that additions, modifications, substitutions and deletions not specifically described may be made without departing from the spirit and scope of the invention as defined in the appended claims.

What is claimed is:

1. A wall-mounted microwave oven having a main body forming a cavity for accommodating foods to cook, a casing enclosing the main body and forming a hood duct having an inlet located on a bottom area and an outlet located on an upper area, a hood fan installed in the hood duct, and a hood motor driving the hood fan, the wall-mounted microwave oven comprising:

a rectifier generating a smoothed-rectified current;

a bypass power line connected between said rectifier and an output of said hood motor, preventing said smoothed-rectified current from being supplied to an input of said hood motor;

a main power line connected between said rectifier and said input of said hood motor;

an inverter part disposed between said rectifier and said main power line to supply said smoothed-rectified current to said input of said hood motor through said main power line during on and off operation; and a microcomputer connected to said inverter part, controlling cycles of on and off operation of said inverter part, thereby controlling the speed of said hood motor in response to an external control signal.

2. The wall-mounted microwave oven according to claim 1, with said inverter part comprising:

first and second transistors alternately turned on; and a driver connected to said first and second transistors, controlling the on and off cycle of said first and second transistors.

3. The wall-mounted microwave oven according to claim 2, further comprising:

a first switching unit provided on an electric power line connected to the inverter part, turning on and off said inverter part; and a hood sensor connected in parallel with the first switching unit, detecting whether or not the operation of the hood fan is needed, turning on and off said inverter part.

4. The wall-mounted microwave oven according to claim 2, further comprising a speed control button connected to said microcomputer, generating said external signal, controlling the speed of the hood motor externally.

5. The wall-mounted microwave oven according to claim 4, with said microcomputer generating a driving signal applied to said first and second transistors, said driving signal having a controlled cycle of on and off operation.

6. The wall-mounted microwave oven according to claim 5, with said microcomputer turning on said first switching unit if said speed control button is selected during driving said hood motor by means of the hood sensor.

7. The apparatus of claim 1, with said bypass power line coupling said rectifier to said output of said hood motor when said main electrical power line is disconnected from said rectifier by said inverter part.

8. The apparatus of claim 1, with said bypass power line disconnecting said rectifier from said output of said hood motor when said main electrical power line is connected to said rectifier by said inverter part.

9. An apparatus in a microwave oven, comprising:

a hood fan installed in a hood duct and a hood motor driving said hood fan;

a rectifier generating a rectified current;

a bypass power line connected between said rectifier and an output of said hood motor;

a main power line connected between said rectifier and said input of said hood motor;

a switching unit disposed between said rectifier and said main power line to perform on and off operations for connection and disconnection between said rectifier and said main power line;

a speed control button generating an external signal; and a microcomputer connected to said switching unit and said speed control button, activating said switching unit in response to said external control signal, controlling cycles of on and off operations of said switching unit during activation of said switching unit in response to said external control signal, thereby controlling the speed of said hood motor.

10. The apparatus of claim 9, with said switching unit comprising first and second transistors alternately turned on.

11. The apparatus of claim 10, further comprised of a driver connected to said first and second transistors, controlling the on and off cycles of said first and second transistors.

12. The apparatus of claim 11, with said microcomputer controlling the cycle of a driving signal applied to said first and second transistors.

13. The apparatus of claim 10, further comprised of a second switching unit provided on an electric power line connected to said switching unit, turning on and off said switching unit.

14. The apparatus of claim 13, further comprised of a hood sensor connected in parallel with the second switching unit, detecting whether or not the operation of the hood fan is needed at a predetermined speed when said switching unit turns off.

15. The apparatus of claim 14, with said microcomputer turning on said second switching unit if said speed control button is selected during driving said hood motor by means of the hood sensor.

16. The apparatus of claim 9, with said micro-computer altering a frequency of said rectified current up to between 100 and 1000 Hz by controlling said cycles of on and off operations of said switching unit.

17. The apparatus of claim 9, with said bypass power line coupling said rectifier to said output of said hood motor when said main electrical power line is disconnected from said rectifier by said switching unit.

18. The apparatus of claim 9, with said bypass power line disconnecting said rectifier from said output of said hood motor when said main electrical power line is connected to said rectifier by said switching unit.

19. The apparatus of claim 9, with said switching unit comprising:

first and second transistors; and said main electrical power line is coupled between said first and second transistors.

20. The apparatus of claim 19, with said switching unit comprising a driver connected to said microcomputer and said first and second transistors, turning on and off said first and second transistors respectively in response to said controlled cycles during activation of said switching unit.

21. A hood motor speed controlling method in a wall-mounted microwave oven having a hood fan installed in the hood duct and a hood motor driving the hood fan, the hood motor speed controlling method comprising the steps of:

providing a smoothed-rectified current;

providing a bypass electrical power line supplying said smoothed-rectified current to an output of said hood motor;

providing a main electrical power line supplying said smoothed-rectified current to an input of said hood motor;

providing a main switching part disposed on said main electrical power line to control the on and off operation of said main electrical power lines;

generating a driving signal to said main switching part in response to an external control signal; and controlling on and off cycles of said driving signal and altering the frequency of said smoothed-rectified current supplied to hood motor through said main electrical power line by applying said controlled driving signal to said main switching part.

22. The hood motor speed controlling method according to claim 21, wherein the frequency of said smoothed-rectified current is altered up to between 100 and 1000 Hz in the frequency altering step.

* * * * *